United States Patent [19]

Wiquel

[11] 4,076,029

[45] Feb. 28, 1978

[54] BRASSIERE

[76] Inventor: Attilio-William Wiquel, c/o Monaco Government Tourist Office, 115 E. 64th St., New York, N.Y. 10021

[21] Appl. No.: 782,534

[22] Filed: Mar. 29, 1977

Related U.S. Application Data

[63] Continuation-in-part of Ser. No. 713,798, Aug. 12, 1976.

[51] Int. Cl.[2] ..... A41C 3/00

[52] U.S. Cl. ..... 128/425; 2/67

[58] Field of Search ..... 2/67; 128/425, 442, 128/488, 492, 502, 483, 486

[56] References Cited

U.S. PATENT DOCUMENTS

| | | | |
|---|---|---|---|
| 2,134,294 | 10/1938 | Yerkes | 128/425 |
| 2,362,974 | 11/1944 | Cohen | 128/425 |

FOREIGN PATENT DOCUMENTS

| | | | |
|---|---|---|---|
| 321,374 | 6/1920 | Germany | 128/483 |

*Primary Examiner*—Doris L. Troutman

[57] ABSTRACT

A brassiere comprises two breast-receiving cups or pockets formed each from one of two flexible elongate strips (or from one half of a unitary flexible strip of twice the length), each strip being split or slit lengthwise from one end to a location near its other end where the two strips are joined together (or near the middle of the unitary strip), the slit forming the strip into two limbs which are crossed over each other to form a conical breast-receiving concavity having its apex at the end of the slit. One limb of each strip has a plurality of apertures therethrough through which the other limb is passed to hold the two limbs in crossed position, and the limbs are provided with fastening means to permit them to serve as back and shoulder straps for the brassiere. The material of the strip or strips may be heat-formed to three-dimensional shape so as to make the breast-receiving cups or concavities conform approximately to parts of spherical surfaces.

9 Claims, 10 Drawing Figures

BRASSIERE

This application is a continuation-in-part of my pending application Ser. No. 713,798 filed Aug. 12, 1976.

The present invention relates to brassieres, and provides a brassiere of simple and economical construction, readily made of as few as three or even of a single piece of fabric, in which latter case the brassiere may be substantially without seams. In the brassiere of the invention, each breast cup or pocket is formed, basically, from a strip of flexible material split lengthwise from one end to a location near the other end, to leave the strip in one piece but with two limbs. The two strips may form the two halves of a unitary strip of double length, which will then be split from both of its ends toward the middle. If the strips are separate, they are joined together in the completed brassiere at the ends thereof remote from the splits. In either case, and considering again the formation of each breast cup, two slot-like apertures are provided in one limb of the strip, substantially parallel to the length of the strip and of its limbs and disposed adjacent to the end of the split. The other limb is rotated in the plane of the strip over the one limb, about the end of the split as a pivot point, thereby forming the material of the strip in the vicinity of that pivot point into a conical shape with the pivot point as the apex thereof. The other limb is then threaded through the apertures in the one limb to hold the two limbs in crossed position with respect to each other, thereby to preserve the breast-receiving cup on the concave side of the conical shape just referred to. The limbs (one for each breast cup) passed through these apertures in the two strips form, in one embodiment of the brassiere of the invention, shoulder straps for the brassiere, while the free ends of the limbs in which those apertures are formed make up, in that embodiment, the two halves of the back strap for the brassiere.

It is emphasized that the two strips mentioned in the description set forth in the preceding paragraph may be the two halves of a single strip, in which case the brassiere may be made (except for fastening means such as snaps or hooks and eyes) of a single piece of flexible material. Alternatively, when the two strips are made of separate pieces of material, one for each breast cup, the two are fastened together by means of a bridge or junction piece between the two breast cups at the front of the brassiere.

BRIEF DESCRIPTION OF THE DRAWING

The invention will now be further described in terms of a number of presently preferred exemplary embodiments thereof and by reference to the accompanying drawing wherein.

Throughout the drawing, corresponding elements of structure in the different embodiments illustrated are identified by the same reference characters.

DETAILED DESCRIPTION OF THE PREFERRED EMBODIMENTS

Figure 1:
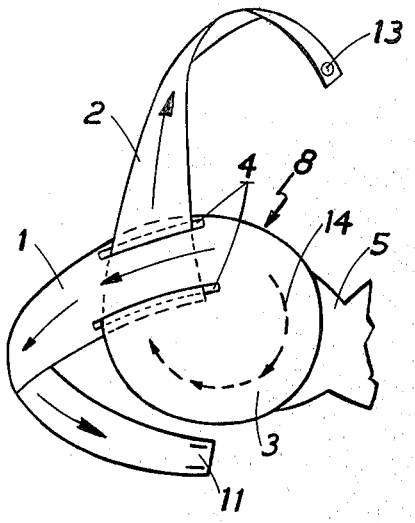
FIG. 1 is a fragmentary front view of a brassiere according to the invention, showing the construction of the breast cups thereof.
Figure 3:
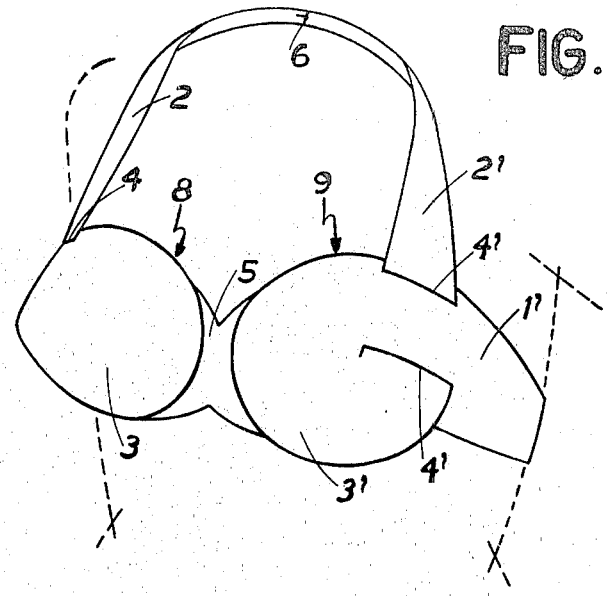
FIG. 3 is a perspective view of the brassiere of FIGS. 1 and 2, illustrating its position on the body of the wearer.
Figure 2:
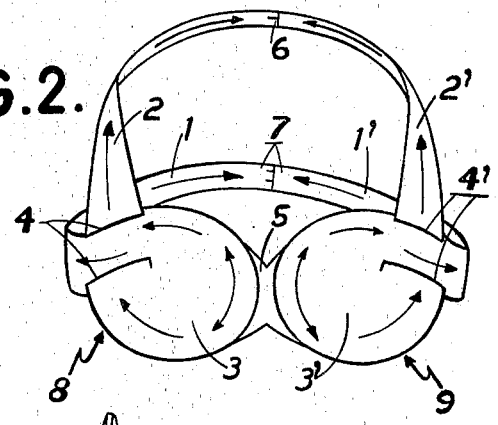
FIG. 2 is a front view of the complete brassiere fragmentarily illustrated in FIG. 1.

Referring to FIGS. 1, 2 and 3, the brassiere there shown comprises two strips of fabric generally indicated at 8 and 9, a junction or bridge piece 5, desirably also of fabric, which fastens the two strips together, and separate two-part fastening means generally indicated at 6 and 7 which may take the form of buttons and buttonholes, snaps, hooks and eyes, or the like. The elements 5, 8 and 9 may however constitute a single, integral piece of fabric or other flexible material, and in the further description of the brassiere of FIGS. 1 to 3 it will be assumed that this is so. The strips 8 and 9 are cut, shaped and assembled, in accordance with the invention, to form each a breast-receiving cup or pocket 3, a shoulder strap 2 and a back strap 1, the shoulder straps being fastened together by the means 6 and the back straps being fastened together by the means 7.

Much as the right and left gloves of a pair of gloves constitute right- and left-hand mirror images of each other, the strips 8 and 9 preferably constitute substantially right- and left-hand mirror images of each other. Accordingly a detailed description of one of them will suffice. Corresponding portions of the two strips are identified in the drawing by the same reference characters, primed however for the portions of the left hand strip 9 (as perceived by the wearer).

Figure 7:
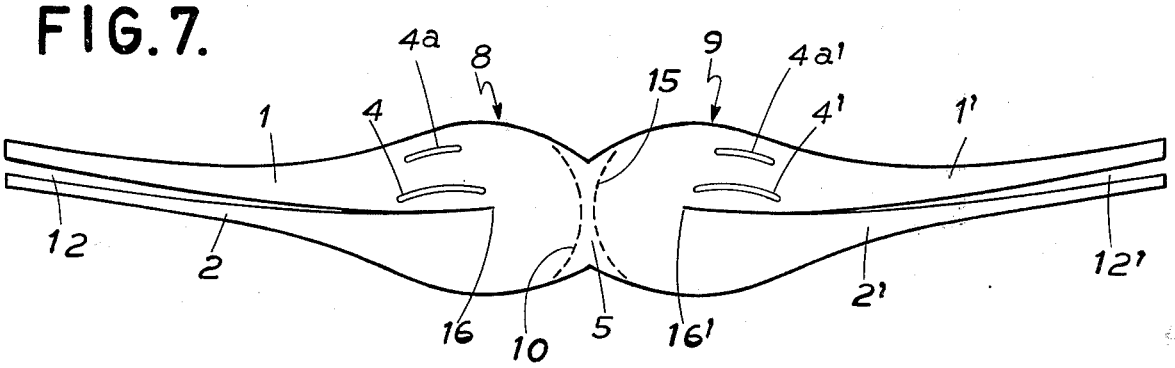
FIG. 7 is a plan view of a single piece of fabric, flat, from which the brassiere of FIGS. 1 to 3 may be made, or from which, with suitable changes in the outline of the piece, the brassieres of FIGS. 4, 5 and 6 may be made.

Referring now to FIG. 7, the brassiere of the embodiment of the invention illustrated in FIGS. 1 to 3 and 7 to 10 is made, except for minor additions, of a single piece of flexible material, for example a woven, knitted or netted fabric, desirably containing thermoplastic fibers. FIG. 7 shows this single piece of fabric as it appears when flat, cut from a piece of cloth. Whether of a single, integral piece of flexible material or not, the brassiere of FIGS. 1 to 3 and 7 to 10 may be regarded functionally as comprising a strip generally indicated at 8, including all of the flexible material to the left of the dash line 10 in FIG. 7, a strip generally indicated at 9 including all of the flexible material to the right of the dash line 15 in FIG. 7, and a bridge or junction piece 5 including all of the flexible material between the dash lines 10 and 15.

If the strips 8 and 9 and the bridge piece 5 constitute a single, integral piece of material, the dash lines 10 and 15 need correspond to no physical structure. If the strips 8 and 9 and the bridge piece 5 are separate pieces of material, the dash lines 10 and 15 may represent seams, sewn or heat-sealed for example, by means of which the pieces 8, 9 and 5 are fastened together.

In either case, the strips 8 and 9 are split, as indicated at 12 for the strip 8 and at 12' for the strip 9 in FIG. 7, from the free ends thereof remote from the bridge piece 5 to a location 16 (16' for strip 9) near the bridge piece 5. Each strip is thereby divided into two limbs, 1 and 2 for the strip 8 and 1' and 2' for the strip 9, extending from the location 16 (16' for the strip 9) to the free end of the strip. The strips 8 and 9 are tapered, as indicated in FIG. 7, so as to have appropriate large width in the breast cup portions thereof about the locations 16 and 16' and suitable narrow width in the remainder thereof toward the free end of the limbs 1, 1' and 2, 2' from which respectively the back and shoulder straps of the brassiere are made. These limbs may be cut to suitable lengths, which may be unequal, and elasticized portions or devices for adjustment of length by the wearer may be incorporated into one or more of the four limbs. The splits or slits 12 and 12' may amount over part or all of their length to notches, from which fabric has been removed, as distinguished from mere cuts.

Two slot-like apertures, 4 for strip 8 and 4' for strip 9, are formed in one limb of each strip, extending generally parallel to the length of the strip from the vicinity of the locations 16 and 16' toward the free end of the strip.

Figure 8:
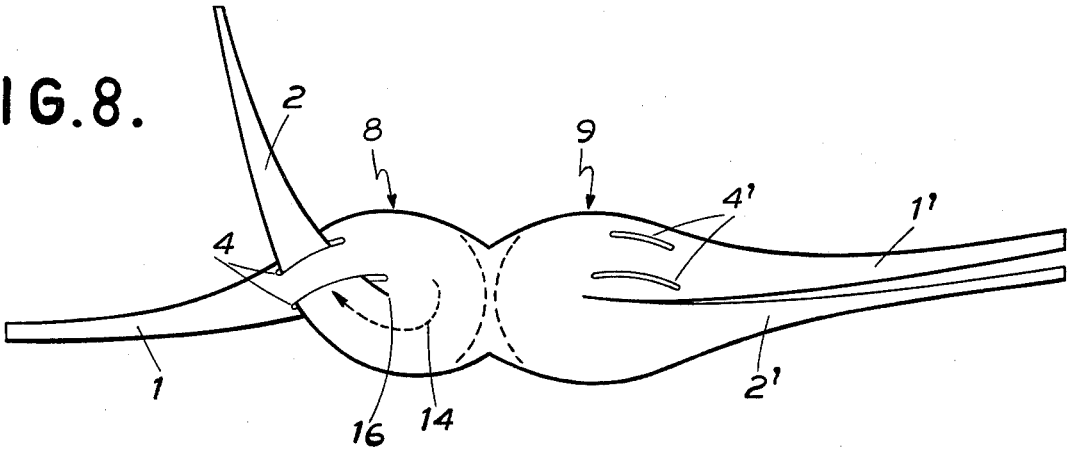
FIG. 8 is a plan view of the fabric of FIG. 7, but with one breast-receiving cup formed to concave shape.

As indicated in FIG. 8 by the dash-line arrow 14 (for the strip 8), the other limb of each strip is rotated in the plane of the strip about the end of the slit (i.e., about the end 16 of the slit 12, for the strip 8) and without twisting that limb about its lengthwise dimension, and is threaded and pulled through the apertures 4 one after another. This other limb is, for the strip 8, the limb 2; for the strip 9 it is the limb 2'. The limbs 1 and 2 are thereby crossed over each other beginning at the location 16, and are held in crossed position by passage of the limb 2 through the apertures in the limb 1.

Figure 9:
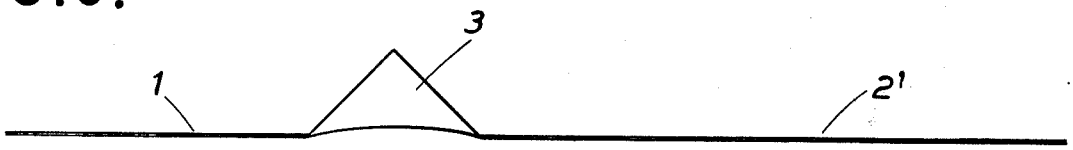
FIG. 9 is a view in side elevation of the uncompleted brassiere of FIG. 8 in the state of partial assembly shown in FIG. 8.
Figure 10:
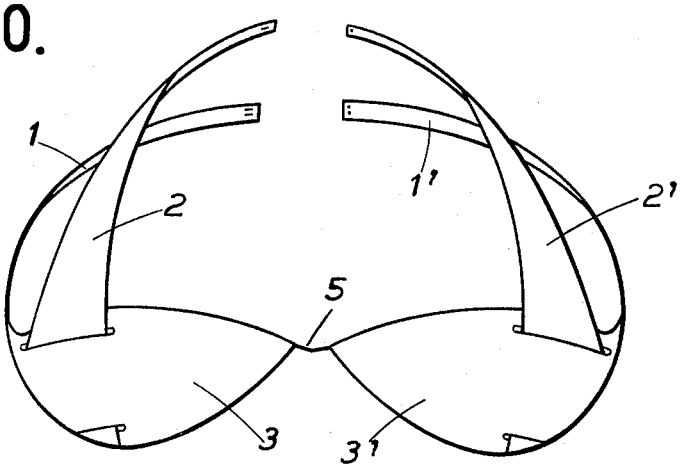
FIG. 10 is a plan view of the completed brassiere of FIG. 2, in the shape assumed by it when worn, the back and shoulder straps being however shown unfastened.

In consequence, the material of the strip 8 between the bridge piece 5 and the outer ends of the apertures 4 takes on the shape of a shallow cone with its apex at the end 16 of the slit 12, as illustrated in FIG. 9. Thus is formed, at least preliminarily, the breast-receiving cup 3 of the brassiere of the invention. In similar fashion the limb 2' is crossed over the limb 1' and is threaded through the apertures 4' in the limb 1' to form the cup 3'.

Advantageously moreover the strips 8 and 9 are made of a material including thermoplastic fibers, and the cups 3 and 3' are subjected to a heat forming operation by pressing between shaped, heated dies or the like, to impart to the fabric a true three-dimensional shape which may approximate a portion of the surface of a sphere.

In my copending application Ser. No. 713,798 above referred to the brassiere of the present invention, which is the same as the brassiere of that application, is illustrated in a drawing identical with FIGS. 1 to 6 of the present application. In that copending application that brassiere is described as composed of two strips each turned on itself in its own plane and without twisting and passed through two slits near the mid-portion of the strip to form a cup or pocket, the two strips being moreover joined together at the cup portions thereof. The strips 8 and 9, to the left and right of the dash lines 10 and 15 of FIG. 7 do indeed constitute such strips, extending (e.g. in the case of the strip 8) from the free end of the limb 1 to the free end of the limb 2, the portion of the strip making up the limb 2 having already been turned through substantially 180° from an initial position, not shown, in which it was collinear with the limb 1 and the material of the strip about the location 16 having stretched during the 180° turning to provide a flat piece of material as shown to the left of the dash line 10 in FIG. 7.

Whether the strips 8 and 9 are formed by such a turning and stretching process, or by cutting a notch or slit 12 as hereinabove described, the result is the same upon turning of the limb 2 over the limb 1 and its passage through the apertures 4: A concave pocket 3 is formed, and the brassiere is essentially complete except the binding or overedging of edges and the application of fastening means, and joining of the strips 8 and 9 by the bridge piece 5 if the strips are not with the piece 5 part of an integral, single piece of fabric or other flexible material.

Thus the edges of the strips 8 and 9 and of the bridge piece 5 (and whether separate or integral) may be overedged if necessary or desirable, according to the nature of the material of which those elements are made, in order to protect the skin of the wearer, to prevent unraveling, or for reasons of appearance.

Figure 4:
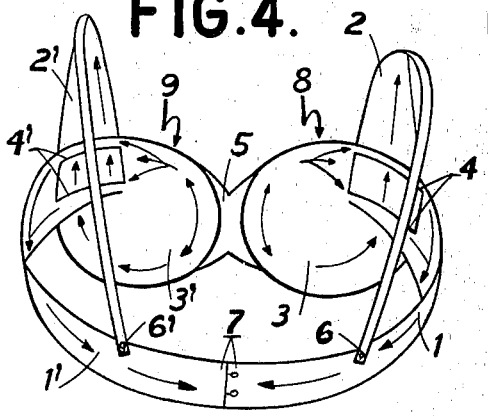
FIG. 4 is a rear view of a brassiere according to the invention in which the shoulder straps attach to the back straps.
Figure 5:
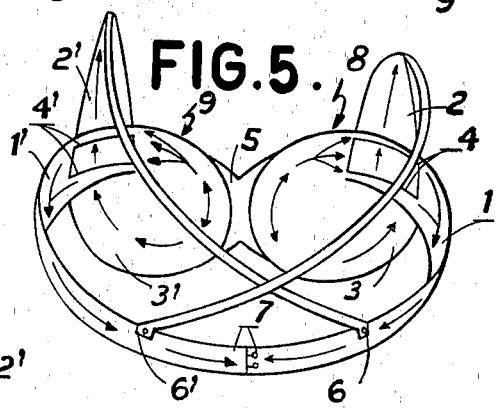
FIG. 5 is a view similar to that of FIG. 4 but illustrating a modified construction.

FIGS. 1 to 3 illustrate an embodiment of the brassiere of the invention in which the shoulder straps made from the limbs 2 and 2' are joined by fastening means 6 to each other, the brassiere being worn "halter style". The fastening means 6 may comprise a button 13 on limb 2 and a buttonhole, not shown, on the end of limb 2'. FIG. 4 illustrates a modified construction in which the shoulder straps are attached to the back straps, shoulder strap 2 attaching to back strap 1 via two-part fastening means 6 and shoulder strap 2' attaching to back strap 1' via a similar two-part fastening means 6'. The limbs or straps 1 and 1' are fastened together by the wearer to provide a back strap, as indicated in FIGS. 1, 2, 4 and 5, by two-part fastening means which may comprise buttonholes 11 (FIG. 1) and buttons visible in FIGS. 4 and 5. The shoulder straps may however be crossed, strap 2 attaching to back strap 1' and shoulder strap 2' attaching to back strap 1, as illustrated in FIG. 5.

Figure 6:
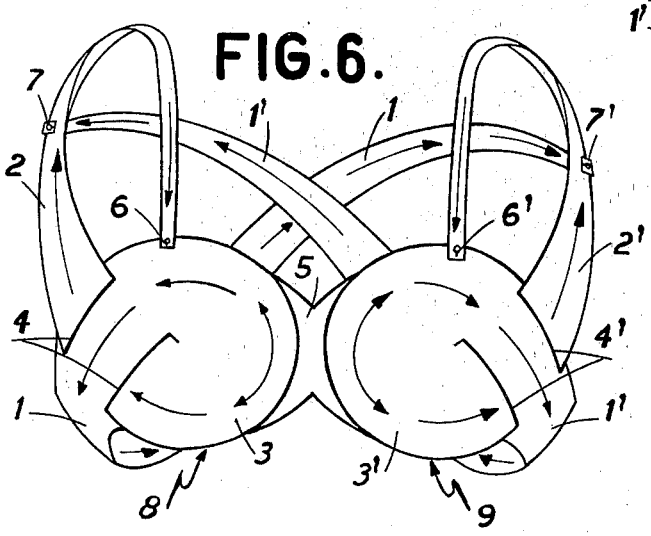
FIG. 6 is a front view of still another embodiment of the brassiere of the invention.

FIG. 6 illustrates still another embodiment of the invention. In FIG. 6 and by comparison with FIGS. 1 to 5 the strips 8 and 9 are rotated respectively counterclockwise and clockwise (as seen in FIG. 6) about the apices 16 and 16' of the conical or approximately conical, concave breast-receiving portions 3 and 3' thereof before affixation of the junction piece 5. The shoulder straps 2 and 2' therefore are destined to pass first under the arms of the wearer and then over the wearer's shoulders from back to front. Shoulder strap 2 therefore fastens to the upper margin of pocket 3 at fastening means 6, and shoulder strap 2' fastens by means of fastening means 6' to the upper margin of pocket 3'. The back straps 1 and 1', instead of fastening to each other, as in the embodiments of FIGS. 1 to 5, cross in the back of the wearer and fasten to the shoulder straps, strap 1 to strap 2' at two-part fastening means 7' and strap 1' at two-part fastening means 7 to strap 2. If in the embodiment of FIG. 6 the strips 8 and 9 form parts of a single, integral piece of flexible material, they will be inclined to each other when the material is flat, as in FIG. 7, instead of being substantially collinear as in that figure.

While the invention has been described hereinabove in terms of a number of presently preferred exemplary embodiments thereof the invention itself is not limited thereto, but rather includes all variations upon and departures from those embodiments falling within the scope of the appended claims. Thus for example either of the two limbs of each strip, i.e., either the limb serving as a back strap (as in the embodiments illustrated) or the limb passing over the wearer's shoulder, may be the limb provided with the apertures 4 through which the other limb is passed to form a concave breast-receiving pocket and to maintain the two limbs in the proper position with respect to each other. Further, other means besides apertures such as the apertures 4 may be provided to maintain the two limbs of each strip in the crossed position by which the breast-receiving cup or pocket is formed. Moreover, each strip may itself be made up of two or more pieces of fabric or other flexible material, suitably sewn or otherwise fastened together. Also, in accordance with the description hereinabove given, the two strips may be separate pieces of material, joined by a bridge piece or other means, or they may together form a single, integral piece of material. The two strips of the claims may accordingly form part of a single piece of material, and the claims are to be understood as encompassing such embodiments as well as those in which the two strips constitute separate pieces of material.

The two slot-like apertures 4 may be of unequal length (as may of course also be the slot-like apertures 4') as is illustrated in FIG. 7. Thus the lengths of the apertures 4 may be graduated to match the widths of the strip 2 at the portions thereof which are located in those apertures after the crossing and threading operation illustrated in FIG. 8. In this way the apertures 4 guide the strip 2 and limit the extent to which the strips 1 and 2 are crossed.

I claim:

1. A brassiere comprising, for each of two breast-receiving cups, an elongate strip of flexible material slit from one end to a location near the other end to form two connected limbs, the limbs being crossed over each other to form a concave breast-receiving cup, and means to hold said limbs in crossed position, the brassiere further comprising means joining said strips together.

2. A brassiere according to claim 1 wherein said strips and joining means form a single integral piece of flexible material.

3. A brassiere according to claim 1 wherein said holding means comprise a plurality of slot-like apertures in one of said limbs through which the other of said limbs is passed.

4. A brassiere according to claim 3 wherein said other limb is tapered in width and wherein said apertures are of unequal lengths substantially matching the widths of said other limb at the portions thereof passing through said apertures.

5. A brassiere according to claim 1 including two-part fastening means for fastening corresponding limbs of said two strips together to form shoulder straps and a back strap for the brassiere.

6. A brassiere according to claim 1 wherein each of said strips is heat-formed to three-dimensional shape in the said cup thereof.

7. A brassiere comprising two flexible strips each having two slits therein, each strip being turned back on itself and passed through its said slits to form a concave breast-receiving pocket in the portion of said strip between the said slits therein and the part of said strip which passes through and is at the said slits therein, the ends of each said strip forming back and shoulder straps for the brassiere, said brassiere further comprising means linking said two strips together at the said portions thereof.

8. A brassiere according to claim 7 wherein said strips are, at least in the said portions thereof, heat-formed to three-dimensional shape.

9. A brassiere according to claim 7 wherein the end of each strip passed through its said slits passes under an arm of the wearer and over a shoulder of the wearer and includes means to affix the said end of that strip to the said portion of that strip.

* * * * *